US008784141B2

(12) United States Patent
Ishikawa et al.

(10) Patent No.: US 8,784,141 B2
(45) Date of Patent: Jul. 22, 2014

(54) CONNECTOR FORMED WITH A RETAINER HAVING TERMINAL ALIGNMENT FEATURES

(75) Inventors: Ryotaro Ishikawa, Yokkaichi (JP); Yutaka Noro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 46 days.

(21) Appl. No.: 13/562,755

(22) Filed: Jul. 31, 2012

(65) Prior Publication Data

US 2013/0040475 A1 Feb. 14, 2013

(30) Foreign Application Priority Data

Aug. 11, 2011 (JP) ..... 2011-175653

(51) Int. Cl.
*H01R 13/514* (2006.01)

(52) U.S. Cl.
USPC ..... 439/752; 439/595

(58) Field of Classification Search
USPC ..... 439/595, 752
See application file for complete search history.

(56) References Cited

U.S. PATENT DOCUMENTS 4,690,477 A * 9/1987 Doutrich et al. ..... 439/595
5,651,703 A * 7/1997 Sasai ..... 439/752
6,146,200 A * 11/2000 Ito et al. ..... 439/596
6,183,313 B1 * 2/2001 Kashiyama ..... 439/752
6,264,507 B1 * 7/2001 Fukamachi ..... 439/752
6,328,613 B1 * 12/2001 Kashiyama ..... 439/752
6,328,614 B1 * 12/2001 Osawa ..... 439/752
6,595,807 B2 * 7/2003 Kashiyama ..... 439/752
6,971,924 B2 * 12/2005 Fujita ..... 439/752
7,131,869 B2 11/2006 Fukatsu
2005/0095909 A1 5/2005 Fukatsu

FOREIGN PATENT DOCUMENTS

JP 2000-260519 9/2000

OTHER PUBLICATIONS

European Search Report.

* cited by examiner

*Primary Examiner* — Thanh Tam Le
(74) *Attorney, Agent, or Firm* — Gerald E. Hespos; Michael J. Porco; Matthew T. Hespos

(57) ABSTRACT

A connector (A) includes a partition (40) for partitioning an insertion hole (35) for a tab (15) and a mold removal space (39) for a locking lance (37). A retainer (44) is pivoted between a partial locking position and a full locking position. A lock (43) restricts a displacement of the retainer (44). A retracted portion (50) is formed in an area (41R) of a facing wall (41) behind the retainer (44) to mold the lock (43) and retracted from an insertion path for a male terminal fitting (10) as compared with an area (41F) of the facing wall (41) before the retainer (44). The retainer (44) includes a restriction (48) for restricting the inclination of the male terminal fitting (10) by being so displaced, at the partial locking position, that a rear end of the male terminal fitting (10) moves toward the retracted portion (50).

14 Claims, 7 Drawing Sheets

CONNECTOR FORMED WITH A RETAINER HAVING TERMINAL ALIGNMENT FEATURES

BACKGROUND OF THE INVENTION

1. Field of the Invention

The invention relates to a connector.

2. Description of the Related Art

U.S. Pat. No. 7,131,869 discloses a connector that has a housing formed with a terminal accommodating chamber. The terminal accommodating chamber has an open rear end and a front wall with an insertion hole. The connector also has a male terminal fitting with a main body and a long narrow tab that projects forward from the main body. The male terminal fitting is inserted from behind into the terminal accommodating chamber until the main body contacts the front wall to stop further forward movement. The tab is inserted in the insertion hole in the front wall and the terminal main body is locked by a locking lance to retain the male terminal fitting. A mold removal space for molding the locking lance communicates with a front part of the terminal accommodating chamber and is open forward at the front wall.

The width of the locking lance and hence the opening width of the mold removal space is larger than the opening width of the insertion hole when the connector is miniaturized. The tab inserted in the insertion hole may be displaced toward such a wide mold removal space if the insertion hole and the mold removal space communicate with each other. Accordingly, the front wall is formed with a partition for partitioning the mold removal space and the insertion hole in a non-communicating manner.

Japanese Unexamined Patent Publication No. 2000-260519 discloses a connector with a mounting hole formed in a facing wall of a terminal accommodating chamber located opposite a locking lance. A retainer is provided at the mounting hole and is pivotable via a hinge between a partial locking position where the male terminal fitting can be inserted into the terminal accommodating chamber and a full locking position where the male terminal fitting is locked and retained in the terminal accommodating chamber.

The retainer disclosed in Japanese Unexamined Patent Publication No. 2000-260519 would be useful in the connector of U.S. Pat. No. 7,131,869. However, the connector disclosed in Japanese Unexamined Patent Publication No. 2000-260519 has a lock at the edge of the mounting hole for locking the retainer to restrict a pivotal movement of the retainer. An area of the facing wall behind the retainer is retracted from an insertion path for the male terminal fitting as compared with an area of the facing wall before the retainer so that the lock can be formed by a mold. A clearance between the inner wall of the terminal accommodating chamber and the male terminal fitting is larger than necessary along this retracted area.

This clearance permits the male terminal fitting to tilt during insertion into the terminal accommodating chamber so that the rear end of the terminal fitting tilts toward the retracted area and a front part of the tab enters the mold removal space. The partition between the tab insertion hole and the mold removal space prevents the male terminal from being returned directly to a proper posture. Thus, the male terminal fitting must be pulled out backward and the inserting operation must be performed again at the correct the posture, thereby reducing operational efficiency.

The invention was completed in view of the above and an object is to prevent a tab from intruding into a mold removal space during insertion into a terminal accommodating chamber.

SUMMARY OF THE INVENTION

The invention relates to a connector with a housing formed with at least one terminal accommodating chamber for receiving a male terminal fitting inserted from behind. A front wall faces the front end of the terminal accommodating chamber and an insertion hole penetrates through the front wall. A tab of the male terminal fitting is inserted through the insertion hole when the male terminal fitting is in the terminal accommodating chamber. A locking lance engages a terminal main body of the male terminal fitting for retaining the male terminal fitting in the terminal accommodating chamber. A mold removal space is provided for the mold that forms the locking lance. The mold removal space communicates with the terminal accommodating chamber and opens toward at the front wall. A partition is formed in the front wall to partition the mold removal space and the insertion hole. A retainer is displaceable between a first position where the male terminal fitting can be inserted into the terminal accommodating chamber and a second position where the male terminal fitting is locked and retained in the terminal accommodating chamber. A lock is provided to restrict a displacement of the retainer. A retracted portion is formed in an area of the facing wall so that the lock can be formed and is retracted from an insertion path for the male terminal fitting as compared with an area of the facing wall before the lock. A restriction projects from a surface of the retainer substantially facing the terminal accommodating chamber and prevents a rear part of the male terminal fitting from moving toward the retracted portion when the retainer is at the first position, thereby restricting the male terminal fitting from being inclined improperly.

The partition in the front wall preferably partitions the mold removal space and the insertion hole in a non-communicating manner.

The connector preferably further comprises a mounting hole in a facing wall of the terminal accommodating chamber substantially opposite to the locking lance across the male terminal fitting.

The retainer preferably is arranged to at least partly close the mounting hole.

The lock preferably is formed at the edge of the mounting hole.

The retracted portion preferably is formed in an area of the facing wall behind the mounting hole.

A clearance between the rear part of the male terminal fitting and the retracted portion is large when the rear part of the male terminal fitting corresponds to the retracted portion during insertion of the male terminal fitting into the terminal accommodating portion. Thus, the rear part of the male terminal fitting may move toward the retracted portion and the posture of the male terminal fitting may incline so that the tab intrudes into the mold removal space. However, movement of the rear part of the male terminal fitting toward the retracted portion is restricted by the restriction provided on the retainer in the present invention, the male terminal fitting is inserted while being kept in a proper posture. In this way, the intrusion of the tab into the mold removal space due to the inclination of the posture of the male terminal fitting is prevented.

The slide-contacts are at two positions spaced apart in forward and backward directions and slide in contact with a slide-contact wall at a locking lance side of the inner wall of the terminal accommodating chamber to keep the terminal main body in a proper insertion posture.

The restriction restricts the inclination of the posture of the male terminal fitting by contacting a part of the terminal main body between the slide-contacts at the two positions when the front end of the tab is behind and near the partition.

The position where the restriction is in contact with the terminal main body is between the slide-contacts at the two front and rear positions that slide in contact with the slide-contact wall to stabilize the posture of the terminal main body. Thus, the posture of the terminal main body will not incline. Further, the front end of the tab is behind and near the partition in this state. Therefore, the tab is inserted into the insertion hole with the posture stabilized by the restriction.

The retainer preferably is pivotally displaceable about at least one hinge integral or unitary to the housing and the retainer.

A formation area of the restriction in a width direction is only a central range of the entire width of the terminal accommodating chamber.

When the hinge is unitary with the housing and the retainer, molten resin reaches the retainer from the housing via the hinge during molding. The hinge is thinned to increase flexibility. Thus, an increase in flow resistance of the molten resin in the hinge is unavoidable. In view of the fact that the molten resin of the hinge is hard to flow, the volume of the retainer needs to be reduced maximally to improve molding efficiency. Accordingly, the formation area of the restriction in the width direction is only the central range of the terminal accommodating chamber. In this way, the volume of the retainer including the restriction is reduced to a minimum necessary level.

These and other objects, features and advantages of the present invention will become more apparent upon reading of the following detailed description of preferred embodiments and accompanying drawings.

DETAILED DESCRIPTION OF THE PREFERRED EMBODIMENT

Figure 1:
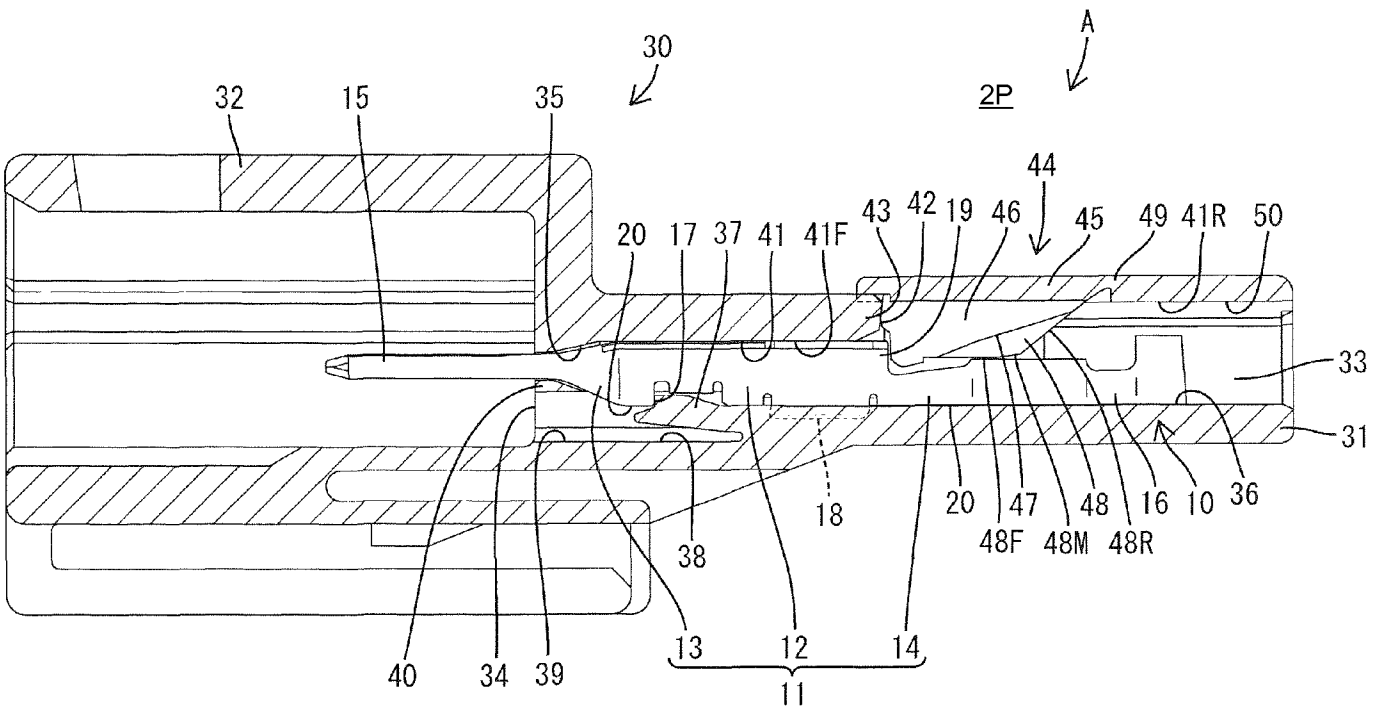
FIG. 1 is a section showing a state where a male terminal fitting is inserted properly and a retainer is located at a full locking position.
Figure 2:
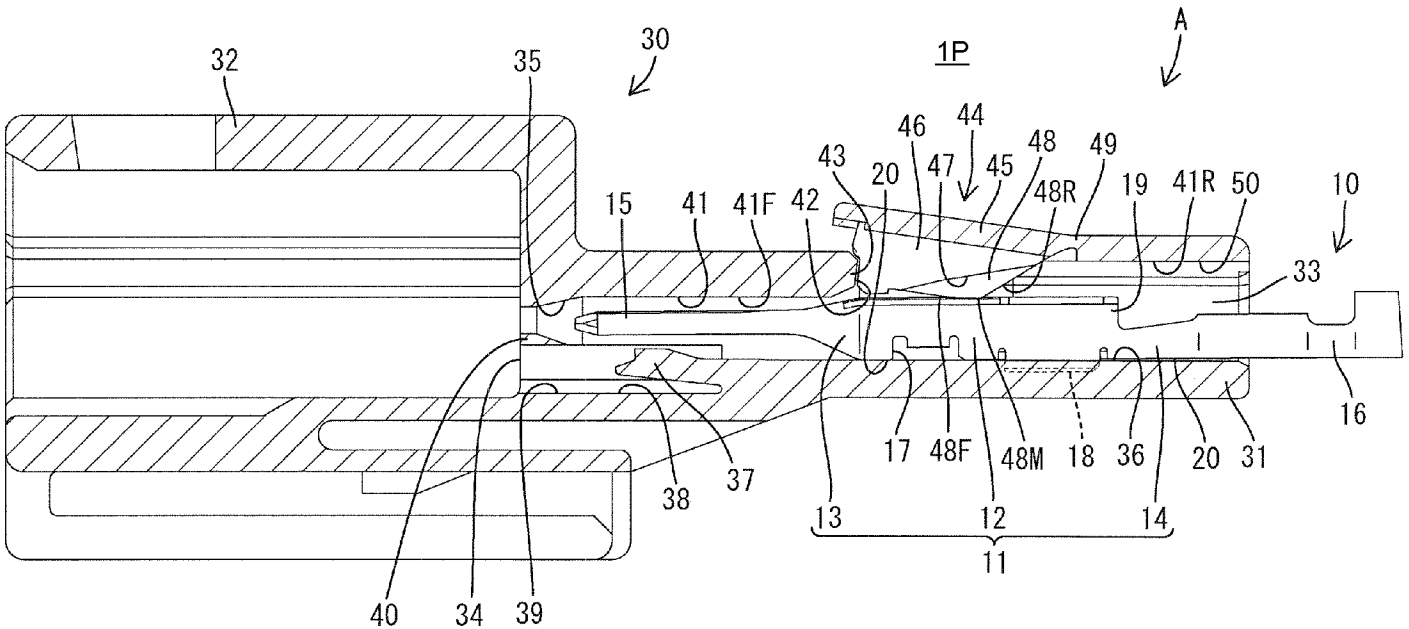
FIG. 2 is a section showing a state while the male terminal fitting is being inserted with the retainer at a partial locking position.

A connector in accordance with the invention is identified generally by the letter A in FIGS. 1 and 2. The connector A of this embodiment includes a housing 30 formed with a terminal accommodating chamber 33 and a long narrow male terminal fitting 10 inserted into the terminal accommodating chamber 33 from behind.

The male terminal fitting 10 includes a main body 11, a long narrow tab 15 that projects forward from the front end of the main body 11 and a wire crimping portion 16 in the form of at least one open barrel extending back from the rear end of the main body 11. The main body 11 has a rectangular tubular box 12, a tapered support 13 projecting forward from the front end of the box 12 and a coupling 14 extending back from the rear end of the box 12. The tab 15 projects forward from the front end of the support 13 and the wire crimping portion 16 extends back from the rear end of the coupling 14. A locking hole 17 is cut into the lower surface of a front part of the box 12 and is engaged by a locking lance 37. A substantially plate-like stabilizer 18 is formed by cutting a part of the lower wall of the box 12 and bending the cut part down at a rear part of the box 12.

The coupling 14 comprises a lower plate at substantially the same height as and flush with the lower surface of the box 12 and left and right side plates standing at substantially right angles from left and right sides of the lower plate. Upper edges of the side plates are lower than the upper surface of the box 12 and a step 19 is formed in an upper edge of the rear end of the box 12 due to this height difference. The step 19 can be engaged by a retainer 44 from behind. A front part of the box 12 before the locking hole 17 and the lower surface of the coupling 14 define slide-contact portions 20 that are spaced apart in forward and backward directions.

Figure 3:
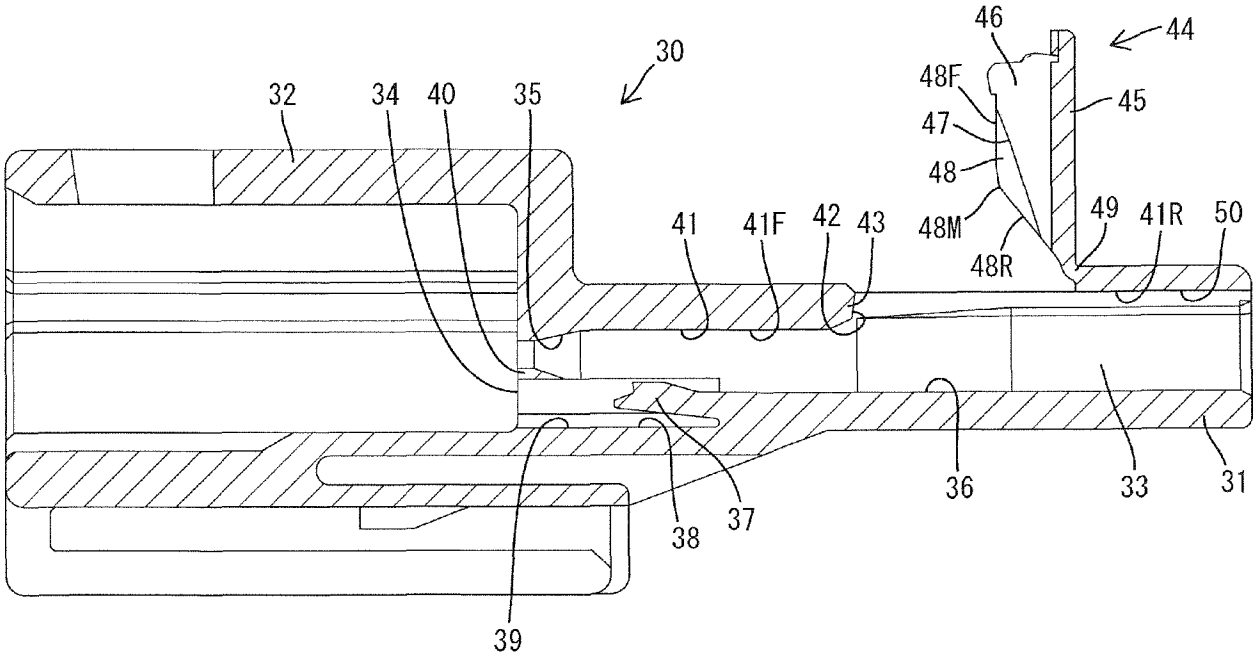
FIG. 3 is a section of a housing showing the retainer located above a main body portion.

The housing 30 is made unitarily e.g. of synthetic resin and includes a main body 31, a rectangular tubular receptacle 32 projecting forward from the front end of the main body 31 and the retainer 44 as shown in FIGS. 1 to 3. The terminal accommodating chamber 33 is formed in the main body 31 and is long in forward and backward directions). A terminal insertion opening is defined at the rear end of the terminal accommodating chamber 33. A front wall 34 is formed at the front end of the main body 31 and has a rear surface facing the front end of the terminal accommodating chamber 33. An insertion hole 35 penetrates the front wall 34 and can receive the tab 15 when the male terminal fitting 10 is inserted properly into the terminal accommodating chamber 33.

A slide-contact wall 36 extends along the bottom of the terminal accommodating chamber 33 and slidably engages the terminal main body 11. A locking lance 37 is cantilevered forward at a front part of the slide-contact wall 36 and is resiliently deformable in a vertical direction crossing the inserting direction of the male terminal fitting 10 into the terminal accommodating chamber 33. A deformation space 38 is formed in the main body 31 so that the locking lance 37 can deform resiliently away from the terminal accommodating chamber 33. A mold removal space 39 also is formed in the main body 31 by removing a mold for molding the locking lance 37 and the deformation space 38. The mold removal space 39 is open in the front wall 34 and communicates with a front part of the terminal accommodating chamber 33 before the locking lance 37.

Figure 4:
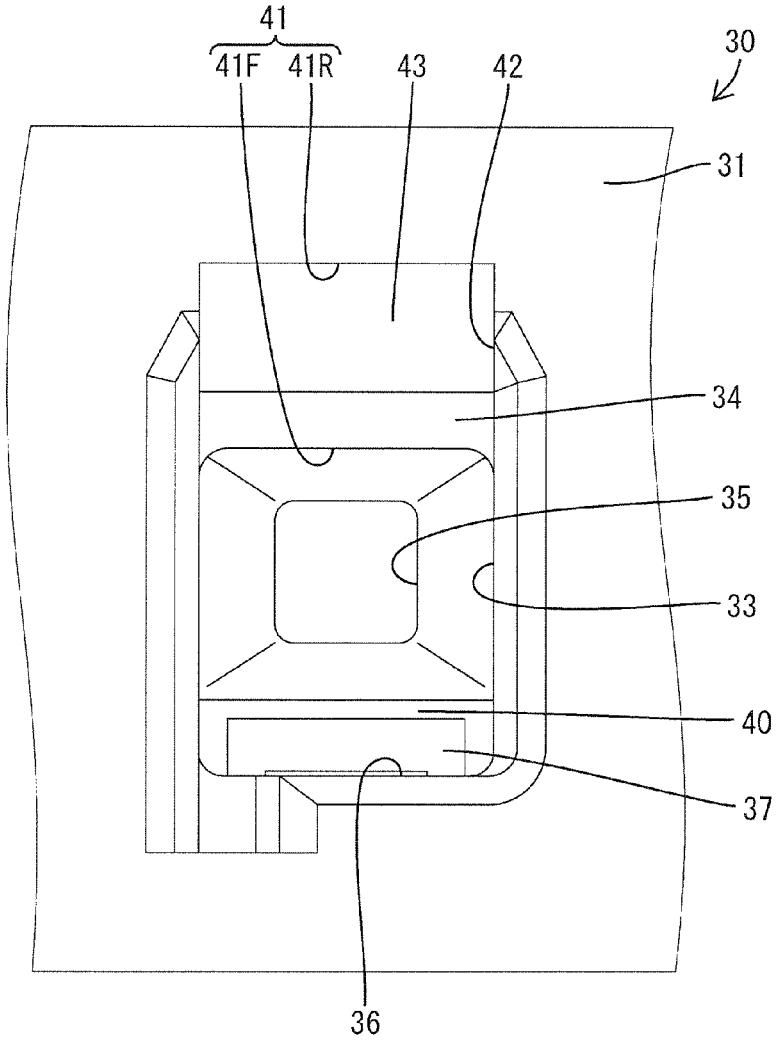
FIG. 4 is a partial enlarged rear view showing a state where the retainer is above the main body of the housing.
Figure 5:
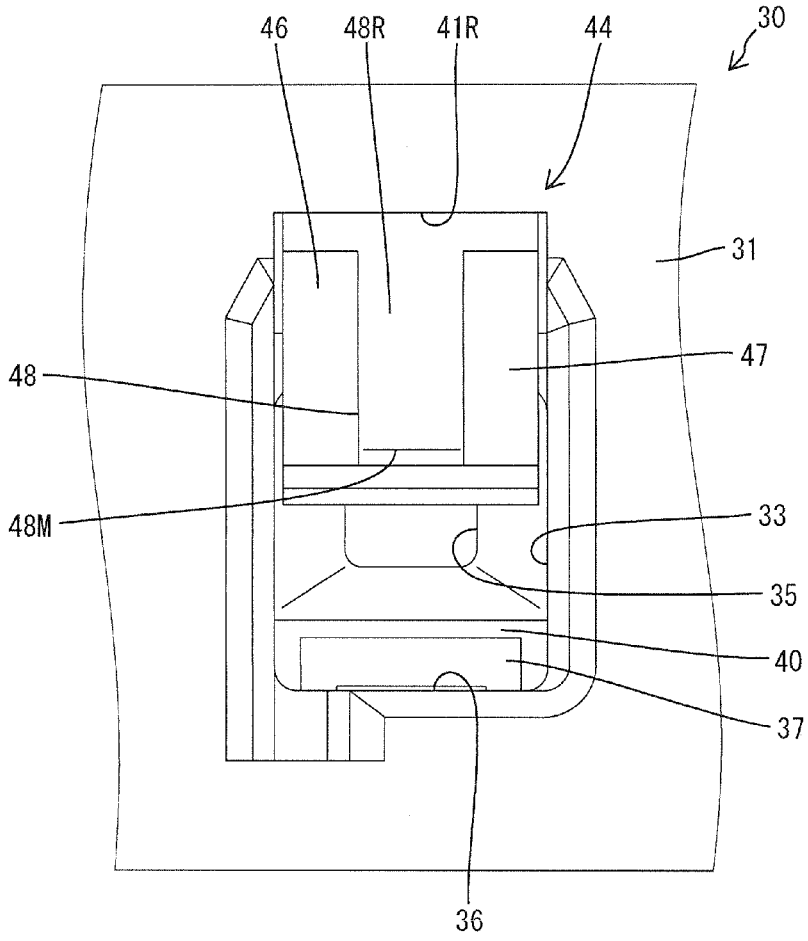
FIG. 5 is a partial enlarged rear view showing the retainer at the full locking position.
Figure 6:
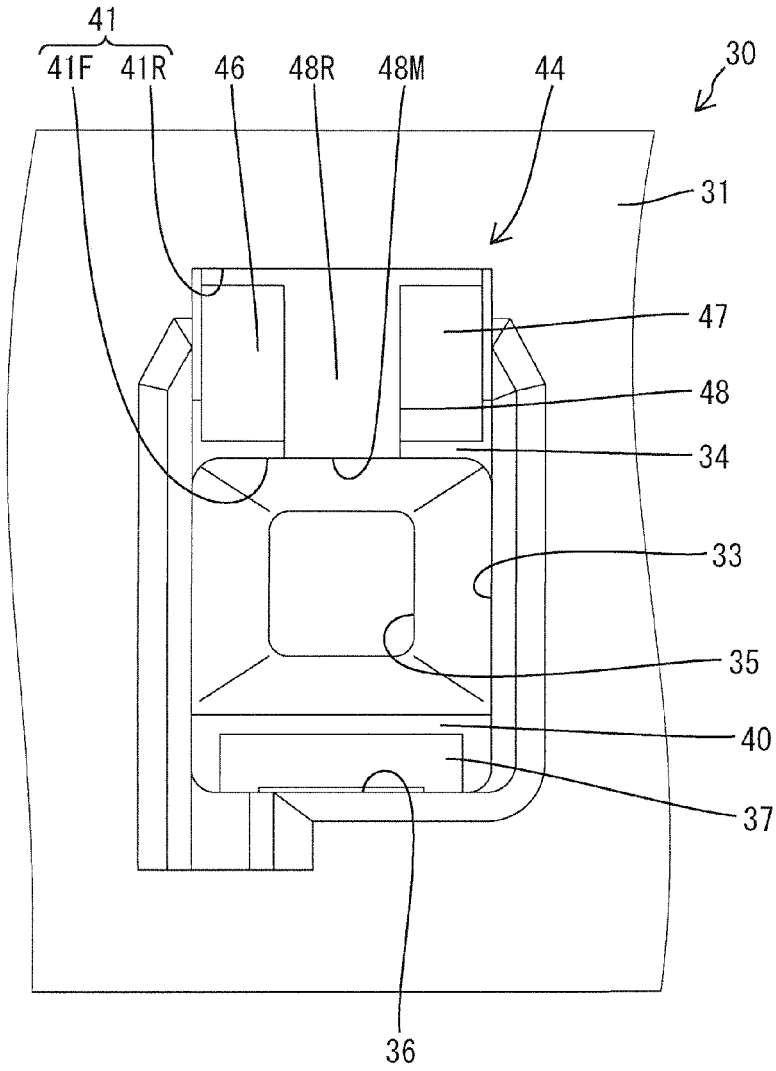
FIG. 6 is a partial enlarged rear view showing the retainer at the partial locking position.

The connector A is miniaturized so that the widths of the locking lance 37 and the mold removal space 39 are larger than the opening width of the insertion hole 35, as shown in FIGS. 4 to 6. If the insertion hole 35 and the mold removal space 39 communicate with each other when there is such a dimensional difference, the tab 15 inserted into the insertion hole 35 may be displaced toward the mold removal space 39, which is wider than the insertion hole 35. Accordingly, the front wall 34 is formed with a partition 40 for partitioning the mold removal space 39 and the insertion hole 35 in a non-communicating manner.

As shown in FIGS. 1 to 3, a facing wall 41 is defined at an upper part of the terminal accommodating chamber 33 vertically opposed to the locking lance 37 and facing the slide-contact wall 36 across the male terminal fitting 10 serves as substantially. The facing wall 41 partitions the terminal accommodating chamber 33 from the outside of the main body 31. A substantially rectangular mounting hole 42 is formed through the facing wall 41 and can be closed by the retainer 44 for retaining the properly inserted male terminal fitting 10 in the terminal accommodating chamber 33. A lock 43 is defined at a front opening edge of the mounting hole 42 for locking a retaining projection 46 of the retainer 44. A formation area of the lock 43 in the vertical direction extends over substantially the entire thickness of the facing wall 41.

The retainer 44 is formed unitarily to include a flat supporting plate 45, the retaining projection 46 projecting from the inner surface of the supporting plate 45 and at least one restriction 48 projecting from a facing surface 47 of the retaining projection 46 facing the terminal accommodating chamber 33. A wide thin hinge 49 is connected to the rear end edge of the supporting plate 45 and to a rear edge of the mounting hole 42. Thus, the retainer 44 is connected to the main body 31 via the hinges 49. In a state immediately after the housing 30 is molded by the mold, the supporting plate 45 of the retainer 44 is at a substantially right angle to the upper surface of the main body 31 so that the mounting hole 42 is entirely open and the interior of the terminal accommodating chamber 33 is exposed to the outside of the main body portion 31, as shown in FIG. 3. The retainer 44 is movable between a partial locking or first position 1P shown in FIG. 2 and a full locking or second position 2P shown in FIG. 1 about the hinge 49.

The front surface of the retaining projection 46 can engage the lock 43 to hold the retainer 44 at the partial locking position 1P with the retaining projection 46 close the mounting hole 42 and facing the interior of the terminal accommodating chamber 33, as shown in FIG. 2. Further, the retaining projection 46 is retracted from an insertion path for the male terminal fitting 10 into the terminal accommodating chamber 33 and the bottom end of the retaining projection 46 is at substantially the same height as the lower surface of an area 41F of the facing wall 41 before the mounting hole 42. Accordingly, the male terminal fitting 10 can be inserted into and withdrawn from the terminal accommodating chamber 33 without interference from the retaining projection 46 of the retainer 44. Further, the supporting plate 45 is inclined up toward the front and projects out from the main body 31, while the facing surface 47 of the retaining projection 46 is inclined down toward the front.

The front surface of the retaining projection 46 also can engage the lock 43 to hold the retainer 44 at the full locking position 2P with the retaining projection 46 closing the mounting hole 42, as shown in FIG. 1. The retainer 44 approaches the male terminal fitting 10 in the terminal accommodating chamber 33 during the pivotable displacement from the partial locking position 1P to the full locking position 2P. As a result, the supporting plate 45 becomes substantially parallel to the inserting direction of the male terminal fitting 10 and the retaining projection 46 is inserted into the insertion path for the male terminal fitting 10 in the terminal accommodating chamber 33. More particularly, the bottom end of the retaining projection 46 projects into the terminal accommodating chamber 33 and beyond the lower surface of the area 41F of the facing wall 41 before the mounting hole 42.

The retainer 44 is held at the partial locking position 1P and the retaining projection 46 is retracted from the insertion path for the male terminal fitting 10 while inserting the male terminal fitting 10 into the terminal accommodating chamber 33. The locking lance 37 interferes with the terminal main body 11 during insertion of the male terminal fitting 10 and resiliently deforms toward the deformation space 38. The tab 15 passes through the insertion hole 35 and projects forward from the main body portion 31 when the male terminal fitting 10 is inserted properly, and the locking lance 37 engages the locking hole 17 to retain the male terminal fitting 10. The retainer 44 is displaced from the partial locking position 1P to the full locking position 2P after the male terminal fitting 10 is inserted properly. Thus, the front part of the retaining projection 46 engages the step 19 from behind to retain the male terminal fitting 10.

The lock 43 is at the front edge of the mounting hole 42 and engages the retainer 44 to prevent a displacement of the retainer 44. The lock 43 is formed by a mold (not shown) to be removed backward and extends over substantially the entire thickness of the facing wall 41. A retracted portion 50 is defined in an area 41R of the inner surface of the facing wall 41 behind the mounting hole 42 and forms a recessed path for mold removal. The inner surface of this retracted portion 50 is retracted up from the insertion path for the male terminal fitting 10 as compared with the area 41F of the facing wall 41 before the mounting hole 42. As a result, a vertical clearance between upper surface of the terminal accommodating chamber 33 and the male terminal fitting 10 in the area 41R of the retracted portion 50 may be larger than necessary.

Figure 7:
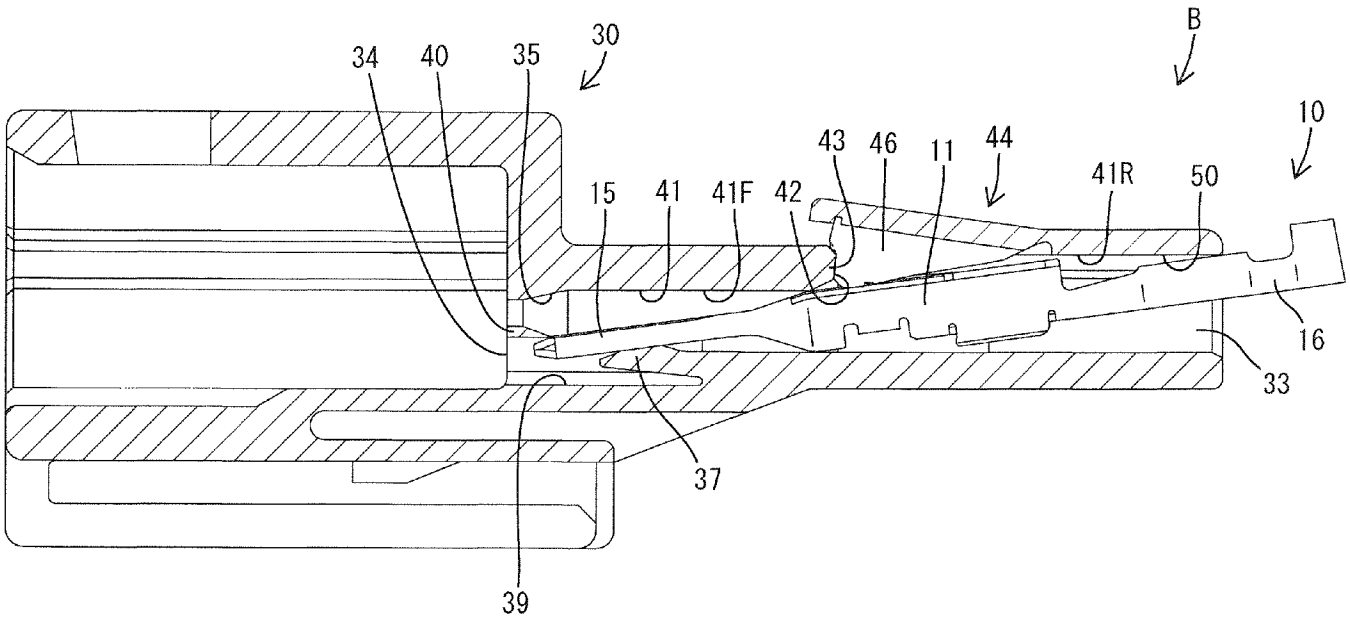
FIG. 7 is a section showing a male terminal fitting tilted into an improper posture and a tab intruding into a mold removal space in a connector which is not formed with a restriction.

A rear end of the male terminal fitting 10 may shift into the retracted portion 50 during insertion into the terminal accommodating chamber 33 so that the entire male terminal fitting 10 is inclined obliquely down toward the front. A front end of the tab 15 of the obliquely inclined male terminal fitting 10 may enter the mold removal space 39, as in a connector B of FIG. 7. The partition 40 between the insertion hole 35 and the mold removal space 39 prevents the male terminal fitting 15 from being returned directly from the mold removal space 39 to the insertion hole 35. Rather, the male terminal fitting 10 must be pulled back, the posture must be corrected and an inserting operation must be performed again, with a reduced operational efficiency.

The restriction 48 projects from the facing surface 47 of the retaining projection 46 to avoid the above-described inefficiency. A formation area of the restriction 48 in forward and backward directions extends from a position behind the front end of the retaining projection 46 to a position near the rear end of the retaining projection 46, as shown in FIGS. 1 and 2. A projection distance of the restriction 48 from the facing surface 47 of the retaining projection 46 is maximum in a substantially central part in forward and backward directions and gradually decreases toward the front and the back from this maximum projecting part 48M. Thus, the restriction 48 is substantially triangular when viewed sideways. A substantially flat pressing surface 48F is defined along an area of the restriction 48 facing the terminal accommodating chamber 33 and before the maximum projecting part 48M and a substantially flat guiding surface 48R is defined behind the maximum projecting part 48M. Further, as shown in FIGS. 5 and 6, a formation area of the restriction 48 in a width direction is only a central range of the entire width of the terminal accommodating chamber 33.

The restriction 48 is retracted from the insertion path for the male terminal fitting 10 in the terminal accommodating chamber 33 when the retainer 44 is at the partial locking position 1P, as shown in FIG. 2, and the bottommost end of the maximum projecting part 48M particularly is at substantially the same height as the lower surface of the area 41F of the facing wall 41 before the mounting hole 42. Thus, the restriction 48 does not hinder the inserting and withdrawing of the male terminal fitting 10 into and from the terminal accommodating chamber 33.

In the process of inserting the male terminal fitting 10, the restriction 48 fulfills the following function. The front end of the tab 15 slides in contact with the guiding surface 48R if the male terminal fitting 10 is inserted in an improper oblique posture inclined up toward the front. As a result, the guiding surface 48R corrects the posture of the male terminal fitting 10. In this way, the tab 15 moves forward as if slipping under the restriction 48 and the male terminal fitting 10 is inserted smoothly.

The front and rear slide-contacts 20 are kept in sliding contact with the slide-contact wall 36 after the rear end of the tab 15 passes the maximum projecting part 48M and the upper surface of the terminal main body 11 corresponds to the maximum projecting part 48M until the male terminal fitting 10 is inserted properly. More particularly, the maximum projecting part 48M contacts a part of the upper surface of the terminal main body 11 between the front and rear slide-contacts 20 before the front end of the tab 15 reaches the rear end of the partition 40. In this state, the lower surface of the terminal main body 11 contacts the slide-contact wall 36 at the two slide-contacts 20 and the upper surface of the terminal main body 11 between the two slide-contacts 20 contacts the restriction 48. Thus, the terminal main body 11 is inserted while being kept in a proper posture without being inclined up or down.

The retainer 44 is displaced to the full locking position 2P after the male terminal fitting 10 reaches a proper insertion position. As a result, the pressing surface 48F of the restriction 48 contacts the wire crimping portion 16 from above, as shown in FIG. 1, to restrict an upward displacement of the wire crimping portion 16 toward the retracted portion 50. Thus, vertical inclination of the male terminal fitting 10 is restricted at two positions, i.e. a position before the terminal main body 11 (where the rear part of the tab 15 is in the insertion hole 35) and a position behind the terminal main body 11 (where the wire crimping portion 16 and the pressing surface 48F face each other).

The connector A has: the front wall 34 that faces the front end of the terminal accommodating chamber 33; the insertion hole 35 through the front wall 34 to receive the tab 15 when the male terminal fitting 10 is in the terminal accommodating chamber 33; the locking lance 37 for retaining the male terminal fitting 10 in the terminal accommodating chamber 33; and the mold removal space 39 that communicates with the terminal accommodating chamber 33 and opens toward the front side at the front wall 34. Further, the front wall 34 is formed with the partition 40 for partitioning the mold removal space 39 and the insertion hole 35 in a non-communicating manner. Still further, the housing 30 has the mounting hole 42 in the facing wall 41 of the terminal accommodating chamber 33 opposite the locking lance 37 and the mold removal space. The retainer 44 can at least partly close the mounting hole 42 and is displaceable between the partial locking position 1P and the full locking position 2P. The lock 43 is at the hole edge of the mounting hole 42 to restrict a displacement of the retainer 44. Further, the area 41R of the facing wall 41 behind the mounting hole 42 is formed with the retracted portion 50 that is retracted from the insertion path for the male terminal fitting 10 as compared with the area 41F of the facing wall 41 before the mounting hole 42 to mold the lock.

The presence of this retracted portion 50 could cause the posture of the male terminal fitting 10 to incline. However, the restriction 48 projects from the surface of the retainer 44 facing the terminal accommodating chamber 33 as a countermeasure. The restriction 48 prevents the rear part of the terminal main body 11 and the front part of the wire crimping portion 16 of the male terminal fitting 10 from moving toward the retracted portion 50. Therefore, the male terminal fitting 10 is inserted in a proper posture and the tab 15 cannot intrude into the mold removal space 39.

The front and rear slide-contact portions 20 slide in contact with the slide-contact wall 36 at the locking lance 37 side of the terminal accommodating chamber 33 to keep the terminal main body 11 in a proper insertion posture. The restriction 48 is held in contact with the part of the terminal main body 11 between the slide-contact portions 20 to restrict the inclination of the male terminal fitting 10 when the front end of the tab 15 is behind and near the partition 40. Accordingly, the retaining projection 48 is in contact with the terminal main body 11 between the front and rear slide-contact portions 20 at the front and rear positions and slide in contact with the slide-contact wall 36 to stabilize the posture of the terminal main body 11. Thus, the inclination of the male terminal fitting 10 can be prevented reliably. Further, the front end of the tab 15 is behind and near the partition 40 in this state. Thus, the tab 15 is inserted into the insertion hole 35 with the posture stabilized by the restriction 48.

The retainer 44 is pivotally displaceable about the hinge 49 that is unitary to the housing 30 and the retainer 44. In this case, molten resin reaches the retainer 44 from the housing 30 via the hinge 49 during molding. The hinge 49 is thinned to increase flexibility, an increase in flow resistance of the molten resin in the hinge 49 is unavoidable. In view of the fact that the molten resin of the hinge 49 is hard to flow, the volume of the retainer 44 needs to be maximally reduced to improve molding efficiency. Accordingly, the formation area of the restriction 48 in the width direction is only the central range out of the terminal accommodating chamber 33. In this way, the volume of the retainer 44 including the restricting portion 48 is reduced to a minimum necessary level.

The invention is not limited to the above described embodiment. For example, the following embodiments also are included in the scope of the invention.

The retainer is formed integral to the housing via the hinge in the above embodiment. However, the retainer may be a component separate from the housing. In this case, the retainer can be supported pivotably about the rear end edge thereof.

The formation area of the restriction in the width direction is only the central range of the terminal accommodating chamber in the above embodiment. However, the restriction may extend over the entire width of the terminal accommodating chamber.

Although the restriction restricts the inclination of the posture of the male terminal fitting by contacting the terminal main body in the above embodiment. However, the restriction may restrict the inclination of the male terminal fitting by contacting the wire crimping portion.

The rear part of the terminal main body and the front part of the wire crimping portion of the male terminal fitting correspond to the retracted portion in the state where the inclination of the male terminal fitting is restricted by the restriction in the above embodiment. However, only the terminal main body of the male terminal fitting may correspond to the retracted portion or the rear part of the terminal main body and the entire wire crimping portion of the male terminal fitting may correspond to the retracted portion in the state where the inclination of the male terminal fitting is restricted by the restriction.

What is claimed is:

1. A connector, comprising:

a housing formed with at least one terminal accommodating chamber having opposite front and rear ends and opposite first and second walls extending between the front and rear ends, the second wall having a facing surface facing into the terminal accommodating chamber, the terminal accommodating chamber being configured for receiving a male terminal fitting from behind;

a front wall at the front end of the terminal accommodating chamber;

an insertion hole penetrating through the front wall for allowing insertion of a tab of the terminal fitting therethrough when the terminal fitting is inserted in the terminal accommodating chamber;

a locking lance projecting from the first wall and engageable with a main body of the terminal fitting for retaining the terminal fitting in the terminal accommodating chamber;

a mold removal space between the first wall and the locking lance and being open through the front wall, the mold removal space communicating with the terminal accommodating chamber;

the front wall including a partition between the mold removal space and the insertion hole;

a mounting hole formed through the second wall at a position rearward of the locking lance;

a retainer pivotably connected to the second wall rearward of the mounting hole and displaceable between a first position where insertion of the terminal fitting into the terminal accommodating chamber is permitted and a second position where the terminal fitting is locked and retained in the terminal accommodating chamber;

a lock provided forward of the mounting hole to restrict a displacement of the retainer;

a retracted portion formed in an area of the second wall from the mounting hole to the rear end of the terminal accommodating chamber to mold the lock and retracted from an insertion path for the male terminal fitting; and a restriction projecting from a surface of the retainer substantially facing the terminal accommodating chamber, the restriction having a maximum projecting portion aligned with the facing surface when the retainer is in the first position for restricting inclination of the male terminal fitting toward the retracted portion when the retainer is at the first position, the restriction further having a flat pressing surface forward of the maximum projecting portion and pressing the terminal fitting toward the first wall when the retainer is in the second position and a guiding surface rearward of the maximum projecting portion and being sloped to guide the terminal fitting into the terminal accommodating chamber and toward the insertion hole when the retainer is in the first position.

2. The connector of claim 1, wherein the partition partitions the mold removal space and the insertion hole in a non-communicating manner.

3. The connector of claim 1, wherein the retainer is arranged to at least partly close the mounting hole.

4. The connector of claim 3, wherein the lock is formed at an edge of the mounting hole.

5. The connector of claim 1, wherein the main body has slide-contact portions at two positions on the first wall spaced apart in forward and backward directions and that slide in contact with a slide-contact surface of the first wall of the terminal accommodating chamber.

6. The connector of claim 5, wherein the restriction restricts an inclination of the male terminal fitting by contacting a part of the terminal main body between the slide-contact portions when a front end of the tab is behind and near the partition.

7. The connector of claim 1, wherein the retainer is pivotally displaceable about at least one hinge unitary to the housing and the retainer.

8. The connector of claim 1, wherein a formation area of the restriction in a width direction is only a central range of the terminal accommodating chamber.

9. A connector, comprising:

a housing having opposite front and rear ends and opposite first and second walls extending between the front and rear ends, at least one terminal accommodating chamber formed between the first and second walls and extending from the rear end of the housing toward the front end, a locking lance cantilevered forward from the first wall and configured for locking a terminal fitting in the terminal accommodating chamber, the second wall having a facing surface facing the locking lance, a mounting hole formed through the second wall at a position rearward of the locking lance, a lock formed on the second wall and facing rearward into the mounting hole, and a retracted portion formed in an area of the second wall from the mounting hole to the rear end of the housing to mold the lock, a distance from the first wall to the retracted portion exceeding a distance from the first wall to the facing surface;

a retainer pivotably connected to the second wall rearward of the mounting hole and displaceable between first and second positions in the mounting hole, a distance from the first wall to the retainer being no less than the distance from the first wall to the facing surface when the retainer is in the first position, the distance from the first wall to the retainer being less than the distance from the first wall to the facing surface when the retainer is in the second position; and a restriction projecting from the retainer and having a maximum projecting portion aligned with the facing surface when the retainer is in the first position for restricting inclination of the terminal fitting toward the retracted portion when the retainer is at the first position, the restriction further having a flat pressing surface forward of the maximum projecting portion and pressing the terminal fitting toward the first wall when the retainer is in the second position and a guiding surface rearward of the maximum projecting portion and being sloped to guide the male terminal fitting into the terminal accommodating chamber when the retainer is in the first position.

10. The connector of claim 9, wherein the retainer is pivotally displaceable about at least one hinge unitary to the housing and the retainer.

11. The connector of claim 9, wherein a formation area of the restriction in a width direction is only a central range of the terminal accommodating chamber.

12. The connector of claim 9, wherein the housing further comprises a front wall with at least one tab insertion hole penetrating through the front wall for allowing insertion of a tab of the terminal fitting when the terminal fitting is inserted in the terminal accommodating chamber.

13. The connector of claim 12, wherein the housing further comprises a mold removal space between the first wall and the locking lance, the mold removal space being open through the front wall and communicating with the terminal accommodating chamber.

14. The connector of claim 13, wherein the front wall includes a partition between the mold removal space and the insertion hole.

* * * * *